US006475132B2

(12) United States Patent
Zettier

(10) Patent No.: US 6,475,132 B2
(45) Date of Patent: Nov. 5, 2002

(54) DOUBLE-INTAKE DISK CENTRIFUGE

(75) Inventor: Karl-Heinz Zettier, Oelde (DE)

(73) Assignee: Westfalia Separator Food Tec GmbH, Oelde (DE)

( * ) Notice: Subject to any disclaimer, the term of this patent is extended or adjusted under 35 U.S.C. 154(b) by 0 days.

(21) Appl. No.: 09/881,015

(22) Filed: Jun. 15, 2001

(65) Prior Publication Data

US 2002/0016245 A1 Feb. 7, 2002

(30) Foreign Application Priority Data

Jun. 16, 2000 (DE) ..... 200 10 743 U

(51) Int. Cl.[7] ..... B04B 1/08; B04B 11/00
(52) U.S. Cl. ..... 494/65; 494/70
(58) Field of Search ..... 494/2–4, 27, 38, 494/41, 65, 67–73

(56) References Cited

U.S. PATENT DOCUMENTS

| | | | | |
|---|---|---|---|---|
| 2,261,394 | A | * | 11/1941 | Lindgren |
| 2,283,457 | A | | 5/1942 | Pecker |
| 2,910,226 | A | * | 10/1959 | Thylefors |
| 2,924,378 | A | * | 2/1960 | Fitzsimons |
| 3,204,868 | A | * | 9/1965 | Honeychurch |
| 3,250,462 | A | * | 5/1966 | Thylefors |
| 4,015,773 | A | * | 4/1977 | Thylefors |
| 4,759,744 | A | | 7/1988 | Krook |

FOREIGN PATENT DOCUMENTS

| | | | |
|---|---|---|---|
| CH | 182030 | * | 4/1936 |
| DE | 654319 | | 12/1937 |
| DE | 719826 | | 4/1942 |
| DE | 27 05 840 A1 | | 8/1977 |
| DE | 3141356 | * | 4/1983 |
| DE | 272 420 A5 | | 10/1989 |
| EP | 0 486 260 A2 | | 5/1992 |
| EP | 0 619 145 A2 | | 10/1994 |

OTHER PUBLICATIONS

Hanno–R. Lehmann, Karl–Heinz Zettier, *Whey Processing Lines*, Technical–scientific documentation No. 6, Third revised edition 1988, Published by Westfalia Separator AG.

* cited by examiner

*Primary Examiner*—Charles E. Cooley
(74) *Attorney, Agent, or Firm*—Barnes & Thornburg

(57) ABSTRACT

A disk centrifuge having an intake device which includes two mutually separated intakes which are concentric with respect to the axis of rotation of the centrifugal drum and lead from opposite ends into a common distributor in the centrifugal drum. In a process for operating the centrifuge, the intake pressure at the upper intake tube is adjusted to be lower than the discharge pressure at the liquid discharge without a separating disk.

5 Claims, 1 Drawing Sheet

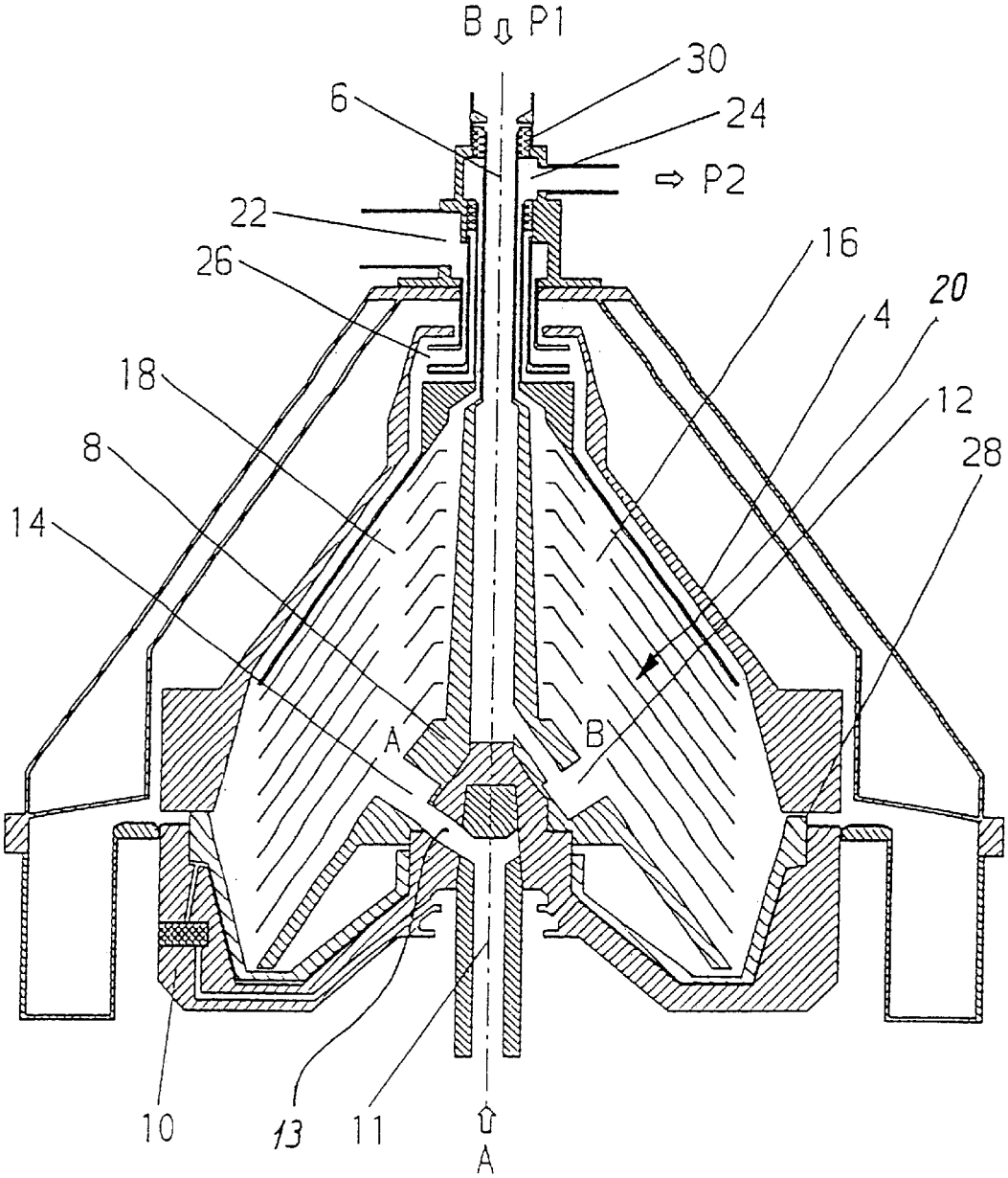
B
P1
30
6
24
P2
22
16
26
20
4
18
12
8
28
14
A
B
10
13
11
A

DOUBLE-INTAKE DISK CENTRIFUGE

BACKGROUND AND SUMMARY OF THE INVENTION

The invention relates to a centrifuge and more specifically to a disk centrifuge.

Centrifuges, particularly disk centrifuges, are known in many different constructions. When cold milk is separated into cream and skimmed milk, the problem arises that, for procedural reasons, the cream cannot be discharged from the separator by a separation disk. For this reason, separators are generally equipped with sliding ring seals for the intake and the discharge.

The installation of sliding ring seals results in a considerable limitation of the inflow cross-sections (diameters) because the diameters of the sliding ring seals are limited based on their maximal circumferential-and sliding speeds.

In order to nevertheless achieve high throughputs, the intake pressure must be increased. This requires that the pumps must reach very high pressures.

It is therefore an object of the invention to improve the centrifuge of the above-mentioned type such that the pressures required for the cold-milk separation can be reduced while the throughput remains the same or the throughput can be increased will the pressures remain the same.

In a disk centrifuge according to the present invention, the intake device has two mutually separated intakes which are concentrically to the axis of rotation of the centrifugal drum and lead from opposite ends into a common distributor in the centrifugal drum. The "double" intake makes it possible to cut the intake pressure in half, while the intake quantity in each intake is the same, in comparison to only one intake. This is irrespective of whether the intake leads into the drum from above or, as also known from the prior art, from below. It also allows the pressures to remain the same with a corresponding increase in the throughput.

Also, by feeding the material from opposite ends and through separate channels or ducts into a common distributor in the drum, the two streams of material do not whirl with each other.

The intake pressure at the upper intake tube is preferably adjusted to be lower than the discharge pressure at the separating-disk-free liquid discharge. As a result, the sealing-off of the upper intake or of the upper intake tube and that of the separating-disk-free liquid discharge can take place by only one joint sliding ring seal.

Other objects, advantages and novel features of the present invention will become apparent from the following detailed description of the invention when considered in conjunction with the accompanying drawings.

BRIEF DESCRIPTION OF THE DRAWINGS

The FIGURE is a sectional view of a disk centrifuge according to the principles of the present invention.

DETAILED DESCRIPTION OF THE PREFERRED EMBODIMENT

The FIGURE illustrates a disk centrifuge 2 which has a centrifugal drum 4 which conically tapers in its upper section.

An upper intake tube 6 extends in the center from above (concentrically to the axis of rotation) into the centrifugal drum 4. The upper intake tube 6 leads into the lower area of the centrifugal drum 4 from above into an intake duct 12 of a distributor 8.

In the lower axial end area of the centrifugal drum 4, a hollow spindle 11, or lower intake, is connected to the bottom part 10 of the drum as another intake. The spindle 11 may have at least two bores 13, one of which is shown leading into intake duct 14 in the distributor 8. Also, both intake ducts 12, 14 may be connected to both intakes 6, 11 or a single intake duct 12, 14 may be connected to both intakes 6, 11.

The centrifugal drum 4 therefore has two mutually separated intakes 6, 11 which jointly form the intake device of the disk centrifuge 2. At least one separate or mutually separated intake duct 12, 14 is assigned to one of the two intakes in the distributor 8. The intake ducts 12, 14 each lead into mutually separated, separate ascending ducts 16, 18 in the disk stack 20 of the centrifugal drum 4.

For letting off two different liquid phases, two liquid discharges 22, 24 are provided of which one is equipped with a separating disk 26 and the other is constructed without a separating disk.

This disk centrifuge 2 operates as follows.

The centrifuged material— particularly cold milk— is guided through the upper intake tube 6 (arrow B) as well as through the lower hollow spindle 11 (arrow A) into the distributor 8. The cold milk then flows into the mutually separated intake ducts 12, 14 and from there into the ascending ducts 16, 18 in the disk stack 20 of the centrifugal drum 4.

The skimmed milk is discharged through the liquid discharge 22 with the separating disk 26, and the cream is discharged through the liquid discharge 24 without a separating disk. A discharge 28 for solids permits the carrying-way of solid residues from the centrifugal drum 4.

The sealing-off of the upper intake or of the upper intake tube 6 and that of the liquid discharge 24 without the separating disk takes place by only one common sliding ring seal 30. In particular, this can be achieved because the intake pressure P1 at the upper intake tube 6 is selected to be lower than the discharge pressure P2 at the discharge without a separating disk, so that the loading of the seal is definite.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A disk centrifuge comprising:

a centrifugal drum having at least one liquid discharge and having an intake device;

the intake device having two separate intakes;

each intake being concentric to an axis of rotation of the centrifugal drum;

one of the intakes, a lower intake, leading from below through a hollow spindle into a common distributor in the centrifugal drum;

the other intake, an upper intake, leading from above through an upper intake tube into the distributor;

separate intake ducts being respectively connected to the two intakes in the distributor; and wherein the intake ducts lead into respectively separate ascending ducts in a plate stack in the centrifugal drum.

2. The centrifuge according to claim 1, wherein at least one of the at least one liquid discharge is constructed without a separating disk.

3. The centrifuge according to claim 2, wherein intake pressure at the upper intake tube is adjusted to be lower than discharge pressure at the at least one liquid discharge without a separating disk.

4. The centrifuge according to claim 1, wherein a sliding ring seals off the upper intake tube from the at least one liquid discharge.

5. The centrifuge according to claim 1, wherein at least one of the at least one liquid discharge is constructed without a separating disk and a single joint sliding ring seal seals off the upper intake tube from the at least one liquid discharge without a separating disk.

* * * * *